US007452187B2

(12) United States Patent
Baker et al.

(10) Patent No.: US 7,452,187 B2
(45) Date of Patent: Nov. 18, 2008

(54) COMPRESSOR WITH LARGE DIAMETER SHROUDED THREE DIMENSIONAL IMPELLER

(75) Inventors: Robert Leroy Baker, Williamsville, NY (US); Ahmed Abdelwahab, Tonawanda, NY (US); Gordon J. Gerber, Boston, NY (US)

(73) Assignee: Praxair Technology, Inc., Danbury, CT (US)

( * ) Notice: Subject to any disclaimer, the term of this patent is extended or adjusted under 35 U.S.C. 154(b) by 497 days.

(21) Appl. No.: 11/199,255

(22) Filed: Aug. 9, 2005

(65) Prior Publication Data

US 2007/0036645 A1 Feb. 15, 2007

(51) Int. Cl.
*F04D 29/26* (2006.01)

(52) U.S. Cl. ..... 416/188

(58) Field of Classification Search ..... 416/186 R, 416/188

See application file for complete search history.

(56) References Cited

U.S. PATENT DOCUMENTS

| | | | | |
|---|---|---|---|---|
| 3,260,443 | A * | 7/1966 | Garnett et al. | 416/186 R |
| 4,093,401 | A | 6/1978 | Gravelle | 416/185 |
| 4,167,369 | A | 9/1979 | Ishihara | 416/185 |
| 4,502,837 | A | 3/1985 | Blair et al. | 415/198.1 |
| 4,543,041 | A | 9/1985 | French et al. | 416/183 |
| 4,596,501 | A | 6/1986 | Wu | 409/131 |
| 4,795,311 | A | 1/1989 | Arkhipov et al. | 416/186 |
| 4,900,225 | A | 2/1990 | Wulf et al. | 415/224.5 |
| 5,735,672 | A | 4/1998 | Mrotek | 416/213 |
| 6,340,287 | B1 | 1/2002 | Eino | 415/199.1 |

FOREIGN PATENT DOCUMENTS

JP 55-64194 * 5/1980

* cited by examiner

*Primary Examiner*—Richard Edgar
(74) *Attorney, Agent, or Firm*—David M. Rosenblum

(57) ABSTRACT

A compressor having a defined large diameter impeller having an integral shroud and having a three dimensional gas flow path defined by the impeller hub surface, blades and the shroud and having a large axially oriented inlet or inducer section with aggressive inducer blades, a defined outlet section geometry, and continuous blade geometries between the inlet and outlet sections.

3 Claims, 2 Drawing Sheets

COMPRESSOR WITH LARGE DIAMETER SHROUDED THREE DIMENSIONAL IMPELLER

TECHNICAL FIELD

This invention relates generally to centrifugal compressors and, more particularly, to centrifugal compressors for use in cryogenic rectification systems such as the cryogenic rectification of air to produce atmospheric gases such as oxygen, nitrogen and argon.

BACKGROUND ART

A centrifugal compressor employs a wheel or impeller mounted on a rotatable shaft positioned within a stationary housing. The wheel defines a gas flow path from the entrance to the exit. A problem encountered with the operation of centrifugal compressors is the leakage of gas from the gas flow path before it completely traverses the gas flow path. This reduces the efficiency of the compressor.

Large diameter centrifugal compressors are used as feed compressors in the cryogenic air separation, non-cryogenic air separation, and process industries and they also are used as booster compressors at elevated inlet pressures in these and other processes. Large diameter impellers typically employ radial blades, i.e. are two dimensional arrangements. The problem of reduced operating efficiency is of particular concern with large diameter centrifugal compressors.

SUMMARY OF THE INVENTION

A compressor comprising an impeller mounted on a shaft, said impeller having a diameter of at least (45.72 centimeters) eighteen inches and defining a first edge of a gas flow path from an inlet section to an outlet section, said inlet section being oriented axially to the shaft and said outlet section being oriented radially to the shaft, a plurality of inducer blades on the impeller in the inlet section said inducer blades stacked along the radial direction to the shaft and oriented to impart work on fluid passing through the flow path by deflecting it in a tangential direction thus changing its angular momentum, a plurality of exit blades on the impeller in the outlet section said exit blades stacked along the axial direction to the shaft and distributed tangentially to the radial direction to impart work on fluid passing through the flow path by accelerating it in the radial direction, and an integral shroud proximate both the inducer blades and the exit blades and defining a second edge of said gas flow path.

The numerals in the Figures are the same for the common elements.

DETAILED DESCRIPTION

In general the invention comprises a centrifugal compressor having a large diameter impeller defining a three dimensional gas flow path, i.e. a gas flow path having a significant axial inlet section as well as a radial outlet section with respect to the shaft, with blades in both of these sections having continuous blade geometries between these two sections, and an integral shroud defining the height of the gas flow path. As used herein the term "integral shroud" means a disc-like component shaped to fit the contour of the impeller blade tips at the outermost surface of the impeller gas path, physically attached to the blade tips along their entire edge, so as to be integral with the blades, i.e. without any gaps or discontinuities. Attachment may be by a fabrication technique such as welding, brazing, fastening or adhesion, or may be part of the raw impeller geometry produced by casting, end milling or molding operations.

Figure 1:
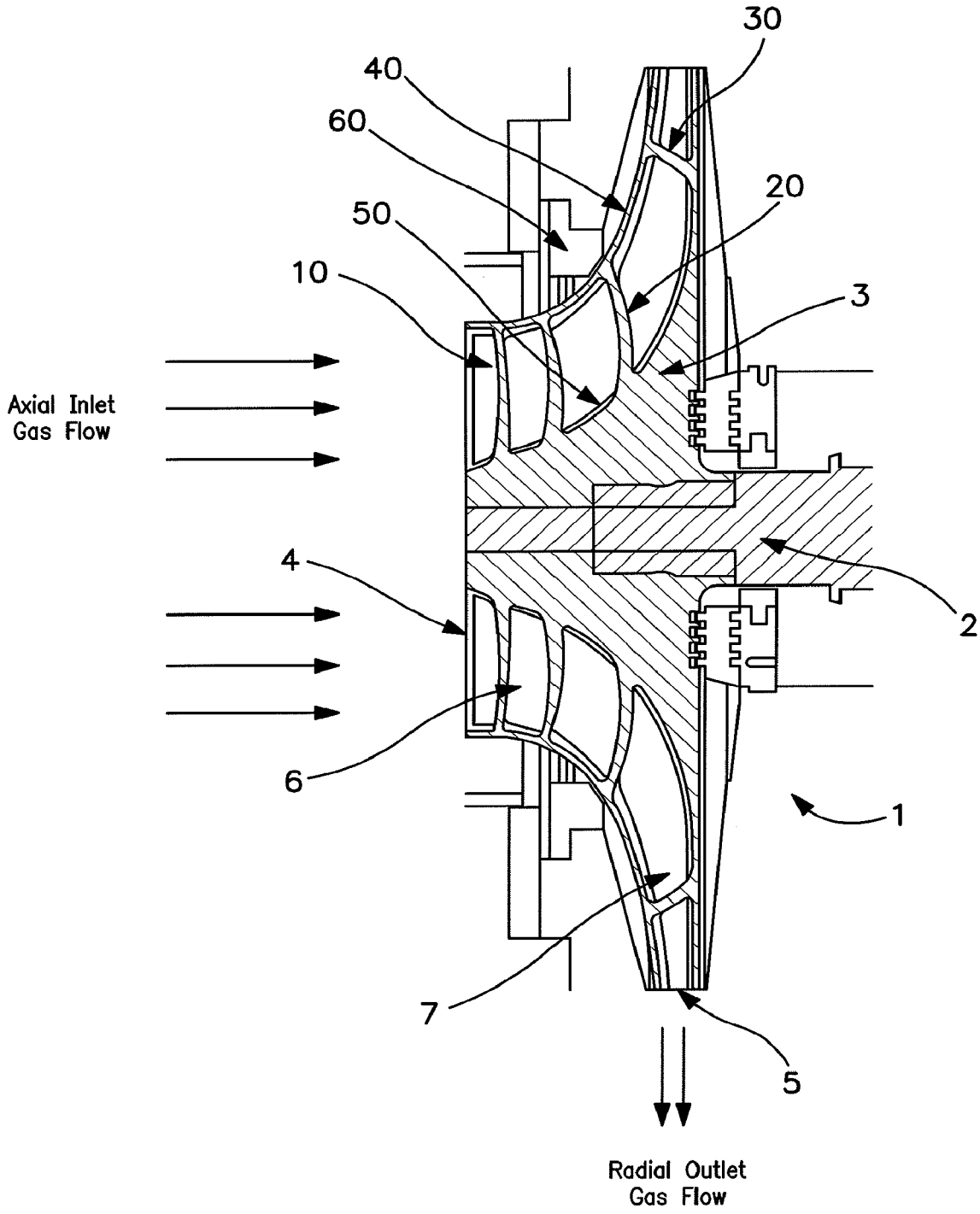
FIG. 1 is a cross sectional representation of one preferred embodiment of the centrifugal compressor of this invention.
Figure 2:
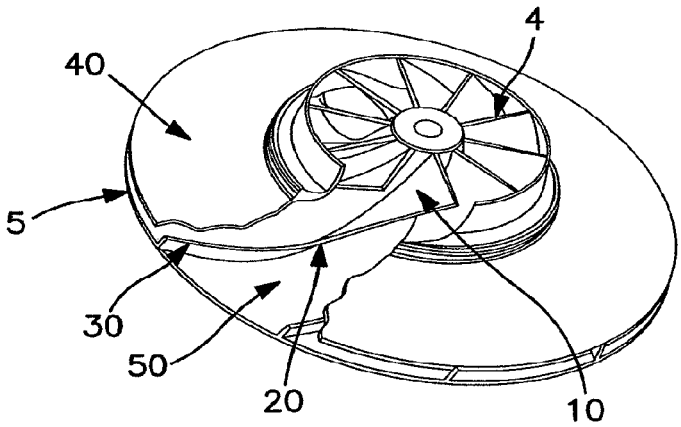
FIG. 2 is an isometric view of a preferred embodiment of the impeller with the integral shroud cut away to show the blade shape geometry.

The invention will be described in greater detail with reference to the Drawings. Referring now to FIG. 1, there is shown centrifugal compressor 1 having a shaft 2 upon which is mounted impeller 3. The surface of impeller 3 defines a first edge or boundary, called the hub 50, of a curved gas flow path from inlet 4 to outlet 5. Inlet 4 communicates with inlet section gas flow path 6 which has an axial orientation with respect to shaft 2 and has a length generally within the range of from 20 to 60 percent of the impeller total axial length.

Inlet section 6 contains a plurality of inducer blades 10 on impeller 3. The inducer blades 10 are characterized by a specified number of blades stacked along the radial direction to the shaft. The inducer blades impart work, i.e. raise the fluid pressure, on the passing fluid by deflecting it in the tangential direction thus changing its angular momentum.

Outlet 5 communicates with outlet section 7 which has a radial, i.e. orthogonal, orientation with respect to shaft 2. Outlet section 7 contains a plurality of exit blades 30 on impeller 3. The exit blades 30 are characterized by a specified number of blades stacked along the axial direction and distributed tangentially with either pure radial, backswept, or leaned angles to the radial direction. The blades impart work on the fluid primarily by accelerating it in the radial direction (Coriolis acceleration).

Between inlet section 6 and outlet section 7 of the gas flow path are blade sections 20 on impeller 3 which have continuous blade geometries which provide optimal gas flow paths between blades without discontinuities between inlet and outlet sections. Continuous blade geometry efficiently guides the predominantly axial gas flow from the aggressive inducer blade section at the inlet of the impeller to the exit blade section at the outlet of the impeller, where the flow is predominantly radial. Geometric and aerodynamic discontinuities would interrupt this smooth transition so all four surfaces of the impeller gas path must be properly defined, including the blades, hub and shroud profiles.

Integral shroud 40 is located proximate the edges of both the inducer blades and the exit blades and defines a second continuous edge or boundary of the gas flow path. Integral shroud 40 defines the height of the interblade gas flow path measured from the surface of impeller 3, and allows the use of axial labyrinth gas seals 60 to further reduce gas leakage from the gas flow path and thus improve the operating efficiency of the compressor.

Figure 3:
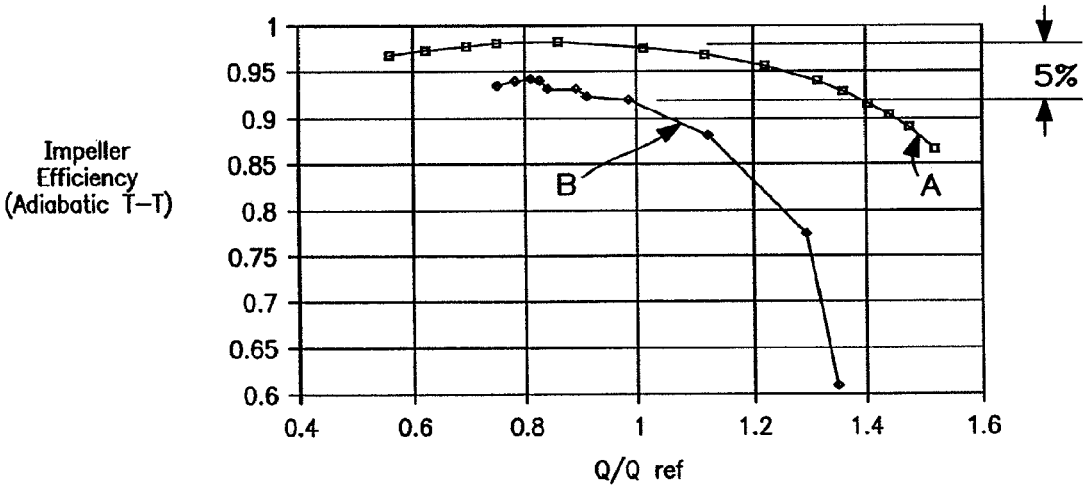
FIG. 3 is a graphical representation of test results showing the impeller adiabatic (isentropic) efficiencies achieved using the centrifugal compressor of this invention and a comparison with impeller adiabatic (isentropic) efficiencies achieved with a conventional centrifugal compressor.

The advantages of the invention compared with conventional machinery with a conventional impeller arrangement is shown in FIG. 3. In FIG. 3 curve A shows the adiabatic (isentropic) efficiency curve for a (68.58 centimeter) 27 inch diameter impeller of an 8000 horsepower, low specific speed centrifugal compressor of the invention, and curve B shows the adiabatic (isentropic) efficiency curve for a conventional, two dimensional, (68.58 centimeters) 27 inch diameter impeller of an 8000 horsepower centrifugal compressor having the same specific speed. As can be seen the invention in this instance provides a five point efficiency improvement over a comparable conventional compressor. The addition of the inducer blades results in the generation of a local pressure gradient in the flow field that counteracts the pressure gradient developed by the transition section between the axial and the radial sections which generally deteriorates the performance of conventional two dimensional impellers (efficiency penalty) and impedes their operating range. It is believed that these results are indicative of results achievable with other size impellers. It is expected that the invention may be advantageously employed with impeller diameters of up to (137.16 centimeters) 54 inches or more.

The adiabatic (isentropic) efficiency is defined as the ratio of the ideal work needed by the fluid to reach a certain discharge pressure to the actual work provided by the compressor. The ideal work is directly related to the discharge pressure while the actual power delivered is related to the internal workings of the compressor aero-thermodynamic behavior. The term "Q/Qref" describes the operating range of the compressor expressed in non-dimensional format as the volumetric flow rate "Q" at a specific operating condition divided by the volumetric flow rate "Qref" at the design condition, sometimes referred to as the reference condition.

The three dimensional impeller of this invention may be manufactured using conventional methods, two of which are machined forgings with milled blade shapes and sand castings with simple machining to fit the assembly. Machined forgings exhibit better surface finish and more precise dimensional control than sand castings. However, 5-axis milled blade shapes are relatively expensive to create. Sand castings are usually less expensive than machined forgings but they are typically made from costly, production time consuming patterns. Consequently, multiple cast impellers are made from one pattern, limiting the aerodynamic design flexibility associated with a "one-size-fits-all" pattern. Shrouded impellers are good casting candidates, since it is difficult to machine internal gas flow paths. Both cast and fabricated impellers derive manufacturing data from solid models. Molds and cores for cast impellers and machine tool paths for fabricated impellers are generated directly from precise solid model geometry definitions, reducing ambiguities associated with complex shapes. Consequently, custom components are much easier to manufacture, including the large diameter, shrouded, 3-dimensional impellers of this invention.

This invention having three dimensional impeller blade shapes, including aggressive inducer or inlet regions or sections, can be applied at any specific speed condition. Specific speed, $N_s$, compares flow rate to pressure rise for a stage of compression:

$$N_s=(M^{1/2}\rho^{1/4}N)/\Delta p^{3/4}$$

Where $N_s$=Specific Speed
M=Mass Flow Rate
ρ=Density
N=Angular Velocity
Δp=Differential Static Pressure True, non-dimensional specific speeds for centrifugal compressors, based on average density, typically range from 0.4 to 1.5 with highest efficiencies for 3-D impeller geometries at about 0.75. Specific speed removes the dimension of size from consideration. Small impellers operating at essentially any specific speed enjoy the opportunity to be designed for optimal efficiency because they can be manufactured easily and have reduced negative operational deflection effects. The novel impeller of this invention allows the same opportunity for large diameter impellers over the same specific speed operating range. Furthermore, since normally low specific speed compressors tend to be of the two dimensional blade types, this invention includes the use of inducer blades with even low specific speed centrifugal compressors to improve their efficiency and range.

Heretofore custom, 3-dimensional impeller geometries have been applied to unshrouded, small diameter impellers that could be 5-axis milled or investment cast. Since custom impellers are slightly more expensive to manufacture than high production volumes of duplicate geometry impellers, they would fit best where efficient power consumption or recovery is important. Custom, large diameter, shrouded, 3-dimensional impellers of this invention may be applied to gas, liquid or multi-phase compression and expansion systems. Ideal gases, real gases or combined mixtures operating over any pressure or temperature range may be addressed. Affordable, increased pressure ratio compression and expansion stages may now be considered.

These impeller systems of this invention may be made from any suitable material required by the fluid and condition of operation, including aluminum, titanium, high alloy steels, carbon steels, cast and ductile irons, copper alloys and non-metallic polymers. Specific custom geometry definitions, such as number of blades, blade thickness, blade shape, splitter blades, diffuser blades, inducer blades, sealing surfaces and mounting arrangements are all possible and affordable.

The compressor of this invention may be used with all suitable gases such as air, nitrogen, oxygen, carbon dioxide, helium and hydrogen at any suitable operating pressure and at any suitable impeller tip speed. It applies to all flow and pressure ranges (all specific speeds) typical of centrifugal compressors. It may be employed in either cryogenic or non-cryogenic service. In a particularly preferred application, the invention is employed in a cryogenic air separation plant as a feed, booster and/or product compressor.

Although the invention has been described in detail with references to a certain preferred embodiment, those skilled in the art will recognize that there are other embodiments of the invention within the spirit and the scope of the claims.

The invention claimed is:

1. A compressor comprising an impeller mounted on a shaft, said impeller having a diameter of at least (45.72 centimeters) eighteen inches and defining a first edge of a gas flow path from an inlet section to an outlet section, said inlet section being oriented axially to the shaft and said outlet section being oriented radially to the shaft, a plurality of inducer blades on the impeller in the inlet section said inducer blades stacked along the radial direction to the shaft and oriented to impart work on fluid passing through the flow path by deflecting it in a tangential direction thus changing its angular momentum, a plurality of exit blades on the impeller in the outlet section said exit blades stacked along the axial direction to the shaft and distributed tangentially to the radial direction to impart work on fluid passing through the flow path by accelerating it in the radial direction, blade sections connecting the inducer blades to the exit blades having a continuous blade geometry without geometric and aerodynamic discontinuities and an integral shroud proximate both the inducer blades and the exit blades and defining a second edge of said gas flow path.

2. The compressor of claim 1 wherein the impeller has a diameter of up to (137.16 centimeters) 54 inches.

3. The compressor of claim 1 wherein the inlet section has a length within the range of from 20 to 60 percent of the impeller total axial length.

* * * * *